United States Patent [19]

Schuler

[11] 4,132,100

[45] Jan. 2, 1979

[54] HAND-OPERATED TOOL FOR BENDING PIPES

[76] Inventor: Jacob P. Schuler, Kerkpad N.Z. 43, Soest, Netherlands

[21] Appl. No.: 784,822

[22] Filed: Apr. 5, 1977

[30] Foreign Application Priority Data

Apr. 7, 1976 [NL] Netherlands ..... 7603646
Mar. 18, 1977 [NL] Netherlands ..... 7702977

[51] Int. Cl.[2] ..... B21D 7/02
[52] U.S. Cl. ..... 72/217; 72/319; 72/388
[58] Field of Search ..... 72/459, 149, 217, 218, 72/310, 318, 319, 387, 388

[56] References Cited

U.S. PATENT DOCUMENTS

| | | | |
|---|---|---|---|
| 361,398 | 4/1887 | Daniels | 72/217 |
| 2,232,819 | 2/1941 | Abramson | 72/217 |
| 2,464,800 | 3/1949 | Franck | 72/388 |
| 3,380,283 | 4/1968 | Wilson | 72/387 |

FOREIGN PATENT DOCUMENTS

| | | | |
|---|---|---|---|
| 417656 | 10/1934 | United Kingdom | 72/388 |

*Primary Examiner*—C.W. Lanham
*Assistant Examiner*—Gene P. Crosby

[57] ABSTRACT

A pipe bender for bending pipes, comprising two pivotally interconnected levers. The first lever is provided with a pivot pin and a circular segment disposed coaxially thereto which defines the inside bend of the pipe to be bent, for which purpose a slot is disposed in the circular circumferential portion, and with a first outer support for the pipe to be bent. The second lever is provided with a fork having two arms which receive the pivot pin, and with a second outer support for the pipe to be bent. The bar of the first lever may pass during the bending operation between the arms of the fork in order to bend a pipe through an angle of 180° (U-shape). To bend pipes of different diameters the circular segment is divided in two parts relative to its median perpendicular plane. These two halves are to be spaced apart by means of spacer means.

30 Claims, 7 Drawing Figures

HAND-OPERATED TOOL FOR BENDING PIPES

The present invention relates to a hand-operated tool for bending pipes.

Many types of hand-operated tools for bending pipes are commercially available.

One of such hand-operated tools, also called pipe bender, comprises substantially two pivotally interconnected levers having a pivot pin affixed to the first lever, and a circular segment disposed coaxially thereto, which defines the inside bend of a pipe to be bent, for which purpose there is disposed a slot in the circular circumferential portion of the circular segment, as well as a first outer support for the pipe to be bent disposed adjacent a circumferential end of the circular segment and spaced apart therefrom; and a fork having two arms disposed at the second lever which receive the above pivot pin, and a second outer support for the pipe to be bent coupled to the second lever.

In this prior art pipe bender, the pipe to be bent has to be inserted between the first outer support and the free circumferential end of the circular segment of the first lever and below the second outer support of the second lever.

In order to easily install the pipe, as indicated above, in the pipe bender, the two outer supports and the free circumferential end of the circular segment should be lined up relative to one another. Such procedure implies that a user, prior to proceeding to the insertion of the pipe, has to keep the pipe bender in a very specific position. Since a hand-operated tool is concerned in this case, and the user, in addition to keeping said parts in lined up position, has also the task to insert the pipe between the said parts, it is very likely that these parts get out of their lined up position, as a result of which the insertion of the pipe will be very difficult. It will be clear that the insertion of the pipe is time consuming.

A second drawback of the piror art pipe bender is that, when the pipe (after insertion) has to be bent, the outer support of the second lever slides along the pipe to provide the pipe with the inside bend defined by the circular segment. In addition to the force required to bend the pipe, also the frictional force as a result of the sliding has to be overcome. Consequently the user has to exert a considerable force.

To ensure during the bending of a pipe that no ridges are produced, both the radius of the circular segment and the cross-section of the slot in the circular segment should as much as possible be adapted to the diameter of the pipe. Consequently it will be clear that when pipes of different diameters have to be bent, a different circular segment will in general have to be applied.

When pipes are to be bent with the conventional pipe bender, having diameters ranging between e.g. 10, 11, 12 . . . 20 mm, ten different circular segments should in general be available, so ten different pipe benders.

Another drawback going with the prior art pipe bender is that the maximum bending angle is about 90°.

It is the object of the invention to eliminate the above drawbacks by providing a pipe bender for bending a pipe, with which the insertion of the pipe can be executed very simply and with which the force to be exerted is minimized, it being furthermore possible to bend pipes of different diameters by means of one circular segment without affecting the quality of the bent pipe, also enabling to bend pipes through a angle exceeding 90°. Furthermore the pipe bender has a very simple construction so that it can be manufactured comparatively cheaply.

The object of the invention is attained in that according to a first embodiment according to the invention, one of the two fork arms is extended relative to the other arm, and carrying the second outer support at the free end of its arm extension; that the arm extension is so bent that in the direction of the free end of said extension, said extension has a receding configuration relative to the direction that is opposite to the direction of the bending operation; and that the second outer support is spaced apart from the pivot pin in the order of at least the diameter of the employed pipe and the radius of the circular segment.

Although pipes can be bent with the pipe bender according to a first embodiment of the invention through angles exceeding 90°, it is not possible to bend pipes with said pipe bender in a U-shape (180°). This is possible though with a second preferred embodiment according to the invention, to which effect the second outer support is disposed between the fork arms and between the circular segment and the second lever arm of the second lever, the fork arm portions between their pivot pin receiving points and the second outer support, in the plane of each of said arms, having such a bent shape that the fork arm portions, seen from the pivot pin receiving points in the direction of the second outer support, have a receding configuration in the direction opposite to the direction of the bending operation, in order to make it possible that the lever arm of the first lever during the bending operation can pass between the free ends of the fork arms, and that the second outer support lies spaced apart from the pivot pin in the order of at least the diameter of the employed pipe and the radius of the circular segment.

Since in the two preferred embodiments the second outer support is spaced apart at least one pipe thickness from the circular segment, the pipe can be very simply disposed between said second outer support and the circular segment.

In order to properly bend the pipe according to the invention, the position of the second outer support relative to the pivot pin bearing is very important. It was experimentally found that when the second outer support recedes too far from the extended centre line of the second lever and going through the pivot pin, the bending of the pipe produces ridges in the inside bend thereof, while, when the second outer support is positioned in the direction of the extended centre line, a greater force has to be exerted to bend the pipe. This force becomes larger according to the second outer support comes closer to the extended centre line. According to the invention the proper distance of the second outer support to the pivot pin bearing is therefore substantially defined in that the distance from the second outer support to the pivot pin, in case of coupled levers, is substantially defined by the distance of a line piece AB, which line, going through the median perpendicular plane of the circular segment, intersects the pivot pin in point A, and intersecting an outer surface tangent of the pipe perpendicularly in B and by the distance of a line section BC, which section is the outer surface tangent going through the point of contact C of the second outer support and pipe, when the pipe, after having been inserted, both is tangential to the second outer support in point C while pressing against the bottom profile of the slot of the circular segment, the ratio of the line sections AB : BC 1 : 1 to 1 : 1½.

For the purpose of bending pipes according to the invention having the same circular segment, the diameters of which are different, the circular segment comprises two halves relative to its median perpendicular plane, which halves can be spaced apart by means of spacing means.

Depending on the diameter of the pipe to be bent, the spacer means comprise one or a plurality of disc-shaped members positioned between the halves. The shape of these members is so chosen that the narrow-edge areas thereof which are contiguous to the bottom profile of the slot, re-enter relative to the bottom profile in order to prevent the production of a contact face between a pipe to be bent in the edges of the disc-shaped members.

Instead of applying disc-shaped members as spacer means, the distance between the halves can also be obtained by rendering one of the halves rotatable about the pivot pin by means of a screw thread.

To avoid that the pipes to be bent are impressed by the angles of the two halves of the circular segment which adjoin the bottom of the slot in an undesirable manner, said angles serving as pressure points, are rounded.

According to the invention the cross-section of the slot adjacent the bottom, in the adjacent halves, has substantially a curvature which corresponds to the radius of the pipe having the smallest diameter from the group of pipes of said different diameters, the cross-section in the direction to the outer edge of the slot remaining substantially equal and resting against the pipe to be bent.

Furthermore it is recommendable to so arrange the pipe bender according to the invention that the pivot pin attached to the first lever is mounted in recesses of the fork arms open towards the circumferential edge.

To further restrict the force to be applied, it is advantageous that the second outer support is a substantially straight cylinder which is rotatable about its axis being perpendicular to the two fork arms, and whereby, for guiding a pipe to be bent, there are disposed along the ends of the cylinder surface radially extending edges.

Since the second outer support serves as retention member for guiding the pipes to be bent, said second outer support should lie centred relative to the pipes. This can be effected when said roller is mounted slidingly along its axis of rotation.

For bending pipes of varying diameters it is advantageous to provide the pipe bender with at least one additional specimen of a first lever with circular segment and first outer support, suitable for bending pipes of a different group of diameters, there being provided for said additional specimen in the second lever a second pivot pin bearing consisting of an additional pair of recesses open towards the edge in the two fork arms, in such a way that the said ratio between said recesses and the second outer support is maintained.

It follows from the above that by means of the construction according to the invention it is very simple to position the pipe in the pipe bender and afterwards, after the pipe has been bent, to remove same from the pipe bender. The installation and the discharge of the pipe can take place easier when the levers have a removable construction. The removable construction on the one hand and the free, open installation of the pipe on the other hand can only be achieved when the second outer support and the first outer support, relative to the centre line of the fork arms, lie on different sides of said centre line.

Two embodiments of the invention will now be described, by way of example, with reference to the accompanying drawings.

In the Figures identical elements are provided with the same reference numerals.

Figure 1:
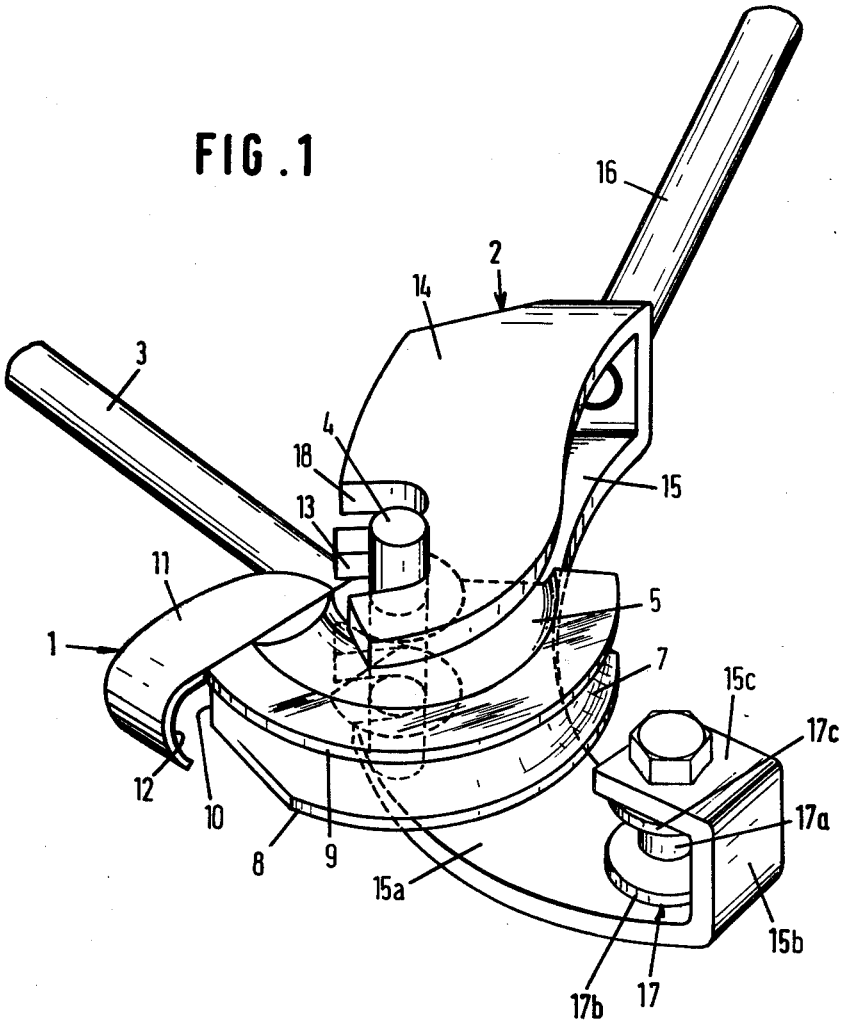
FIG. 1 shows a perspective view of the pipe bender in a first embodiment according to the invention.
Figure 2:
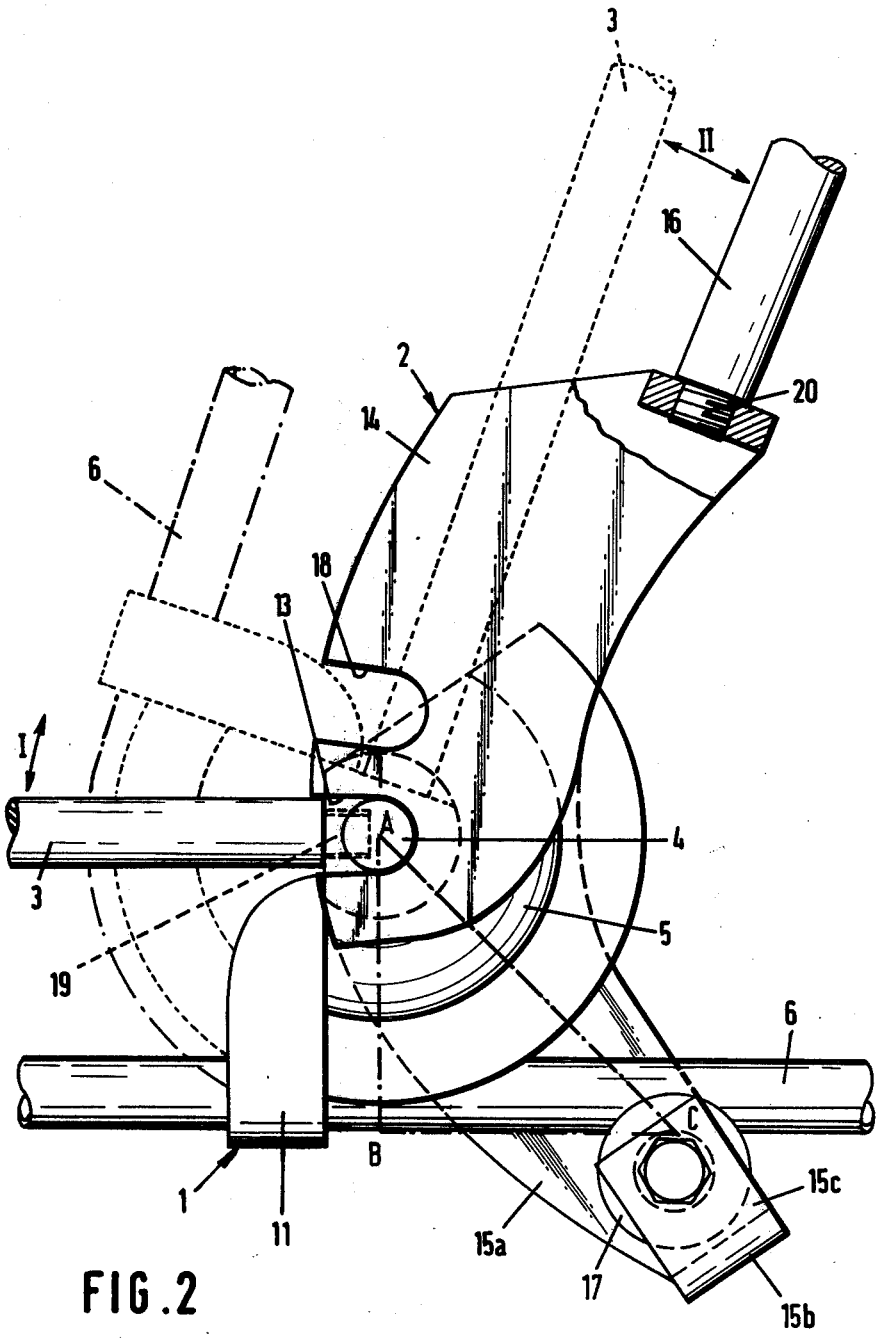
FIG. 2 shows a top view of the pipe bender according to FIG. 1 in two positions, the first position indicating how the pipe has been installed and the second position how the pipe is bent.

In FIGS. 1 and 2 two pivotally interconnected levers 1 and 2 are shown. The first lever 1 comprises a lever bar 3 having at one end thereof a pivot pin 4 perpendicular to said bar, the ends of said pin being pivotal in the fork arms 14 and 15 of the second lever 2 to be defined yet. Coaxial to said pivot pin 4 and in the extension of the lever bar 3 there is disposed a circular segment 5 which determines the inside bend of the pipe to be bent 6 (FIG. 2).

The circular segment 5 is provided circumferentially with a slot 7 having vertical edges 8 and 9 which are positioned in the upper, respectively lower face of the circular segment, and the slot having such a cross-section has to embrace at least partly the pipe to be bent.

At the circumferential end 10 of the circular segment 5 there is disposed a first outer support 11 bent to form a hook, of which the end remote from the hook portion 12 is attached against the outer edge 9 of the circumferential end 10, the free end of the bent hook portion 12 pointing in the direction of the lower edge 8 of the segment. The outer support 11 is substantially perpendicular to the lever bar 3.

In order to easily install the pipe to be bent in the slot 7 and underneath the hook 12, i.e. free installation, such a part of the edge 8 has been removed adjacent the opening of the hook in the lower edge 8 from the circumferential end 10 at the pipe can be inserted between the hook and the removed part of the edge. To facilitate the installation the hook 12 is bevelled at its end, as clearly shown in FIG. 4. The hook 12 is furthermore so formed as to embrace the pipe to be bent.

By making the hook sufficiently wide, it is attained that, when a pipe is inserted between the hook 12 and the slot 7, the hook-embraced pipe section is not damaged during the bending operation. An additional advantage of the wide hook is that the pipe during the bending operation is pressed against the hook and is retained by the hook as a result of the frictional force between the pipe and the hook, so that the pipe does not move relative to the circular segment. It will be clear that as a result the required bending force is considerably reduced.

The two ends of the pivot pin 4 are pivotal in a pair of oppositely disposed recesses 13 adjacent the edge in each of the two fork arms 14 and 15 forming the second lever. The two fork arms 14 and 15 are spaced apart so that the circular segment 5 can freely move between said fork arms. The hook 12 of the circular segment points in the direction of the second fork arm 15. The rcesses 13 are open in the direction of the edges of the two fork arms so that the first lever 1 can be easily removed from the second lever 2. The second lever 2 is provided with a lever bar 16.

Figure 4:
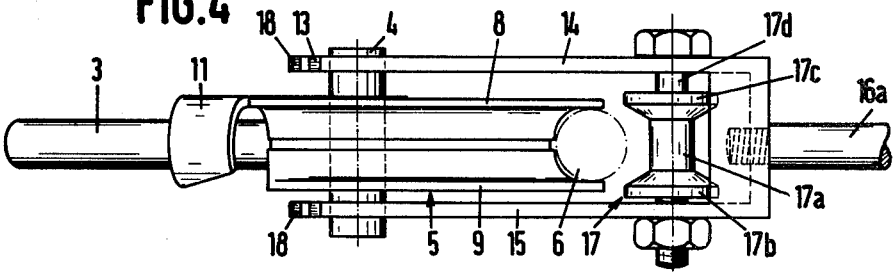
FIG. 4 shows a side view of the pipe bender according to FIG. 3 on the lines IV—IV.

Furthermore the second arm 15 of the second lever 2 comprises an extension 15*a* whose end 15*b* has an U-shape, the free end of the U-shaped portion 15*c* lying in the plane of the first fork arm 14. Between the legs of the U-shaped portion is disposed the second outer support 17 which functions as retention member for the pipe 6 to be bent (FIG. 2). The second outer support is preferably a straight cylinder rotating about its shaft, the shaft ends being mounted in the two U-shaped legs. The shaft is perpendicular to the centre line of the pipe to be bent. For guiding the pipe there are disposed along the ends of the cylinder jacket 17*a* radially outwardly extending edges 17*b* and *c*. The pipe to be bent therefore is conducted between the edges 17*b* and *c* and along the cylinder surface. It will be clear that there will always be one contact pressure point C between the pipe in the cylinder surface (FIG. 2). In view thereof and because of the fact that the second outer support is rotatable, the force required to pass the pipe along said second outer support is very slight. Since pipes of different diameters may be employed, an adequate centring of the second outer support with respect to the employed pipe is desirable. The second outer support is therefor designed slidingly along its shaft 17*d* (FIG. 4).

As indicated already in the beginning, it has been experimentally established that for a proper bending of the pipe and for bending the pipe wth a minimal amount of force, the position of the second outer support relative to the pivot pin is highly important. The distance between the second outer support and the pivot pin should at least be equal to the radius of the circular segment and the diameter of the pipe to be bent, in order to install the pipe at least between the second outer support and the circular segment. More exactly the position of the second outer support can be determined by means of the rectangular triangle ABC shown in FIG. 2, wherein angle B is a right angle. Experimentally it has been established that the ratio AB : BC $\approx$ should be 1 : 1 to 1 : 1½. The position of the second outer support can be determined as follows (lever arms in position I). After the pipe 6 to be bent has been installed between the second outer support 17 and in the slot 7 of the circular sgement 5, and the pipe rests both against the second outer support and against the walls of the slot, the point of contact of the pipe with the second outer support is the point C. From point C there is drawn a tangent along the outer surface of the pipe in the direction of the circular segment. From the pivot pin a line is drawn in the median perpendicular plane of the circular segment which is normal to the tangent. The line from the pivot pin intersects the pivot pin in point A and the tangent in point B. The position of the second outer support can be determined from the above indicated ratio.

Figure 3:
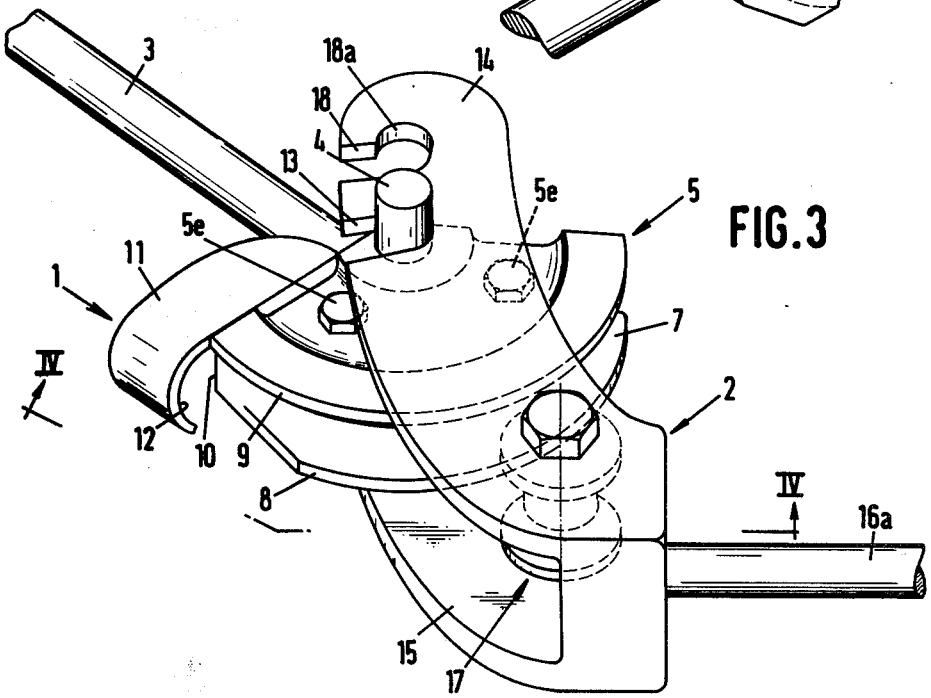
FIG. 3 shows a perspective view of the pipe bender in a second embodiment according to the invention, enabling pipes to be bent in a U-shape (180°), and wherein by way of example the divided circular segment is applied.

FIG. 3 shows a second embodiment according to the invention which has a great similarity with the first embodiment shown in FIG. 1. It appears from a comparison between FIGS. 1 and 3 that the lever rod 16 of FIG. 1 and FIG. 3 (lever rod 16*a*) is displaced to the side of the second outer support, so that consequently the second outer support 17 is disposed between the fork arms 14 and 15 and between the lever bar 16*a* and the circular segment 5. This arrangement makes it possible that during the bending operation the lever bar 3 of the lever 1 can pass between the fork arms 14 and 15, enabling to bend a pipe to a U-shape (180°).

To avoid that the two lever bars 3 and 16*a* in the initial position of the bending operation are not coextensive, the two fork arms 14 and 15 beyond the second outer support 17 seen from the pivot pin, are so bent that in the initial position the lever bars make an angle relative to each other that is smaller than 180°, thus requiring less bending force and moreover becoming more manageable. Furthermore it will be clear that also in this second embodiment the positioning of the second outer support 17 relative to the pivot pin 4 is important. As regards the positioning of said second outer support relative to the pivot pin, reference is made to FIG. 1.

As indicated in the above, the radius of the circular segment 5 and the cross-section of slot 7 should be adapted to the diameter of the pipe to be bent, in other words if pipes having diameters of e.g. 10, 11, 12 . . . 19 and 20 mm are to be bent, ten different circular segments should therefore be available. However it has been experimentally found that the circular segment 5 which is suitable for e.g. a 10 mm pipe (so without necessitating the change of the radius of said circular segment) is also suitable to bend pipes having a diameter of for instance 11, 12, 13, 14 and 15 mm, without producing in the inside bend of said pipe diameters corrugations, provided the cross-section of the slot is optimally adapted to the diameters of the said group of pipes. Furthermore it has been found that the circular segment which is suitable for bending e.g. a 15 mm pipe (also without changing the radius of the segment) is suitable to bend pipes having a diameter of e.g. 16, 17, 18, 19 and 20, without producing corrugations in the inside bend of the latter group of pipes, provided, here too, the cross-section of the slot is optimally adapted to the diameters of the pipes concerned. It will be apparent from these two examples that a specific circular segment is suitable for a specific group of pipes.

Figure 5:
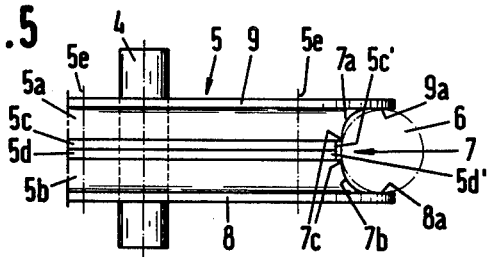
FIG. 5 shows a side view of the divided circular segment with intermediate disc-shaped elements.

As stated in the above, the circular segment 5 is divided in two halves 5*a* and 5*b* relative to its median perpendicular plane in order to adapt the cross-section of the slot 7 (see FIGS. 4 and 5). These two halves are substantially mirror-symmetrical and certainly as regards the cross-section of the slot. By providing between these two halves one or a plurality of disc-shaped elements 5*c*, 5*d*, each element substantially having the shape of the intersected plane of the median perpendicular plane as shown in FIG. 5, the cross-section of the slot 7 is increased. The two circular segment halves 5*a* and 5*b*, as well as the disc-shaped elements 5*c*, 5*d* are centered relative to each other and kept together by means of bolts and nuts 5*e* (see FIGS. 3 and 5) extending through said two halves and elements.

The edge surfaces 5*c*', 5*d*' of the disc-shaped elements bounding the bottom surface of the slot 7, in case the plane of each of said elements is equal to the plane of cross-section of the median perpendicular plane, will result in that the bottom surface of the slot is flat. Said plane becomes larger according as more elements are employed. It is clear that when a pipe is bent, the pipe rests against the flat surface portion, so that the quality of the bent pipe deteriorates. This drawback may be removed by choosing the shape of the disc-shaped elements so that the edge surfaces 5c', 5d' bounding the bottom profile of the slot, recede relative to said bottom profile, as clearly shown in FIG. 5. FIG. 5 also clearly shows how the cross-section of the slot 7 looks like. Said cross-section, adjacent the bottom portion, comprises two circular portions 7a and 7b in respectively the circular segment halves 5a and 5b. The radius of the two circular parts is adapted to e.g. the smallest pipe diameter of 10 mm to be bent, of for instance the group of pipes having diameters of 10 – 15 mm. According to this example, when bending a pipe of 10 mm (so without application of disc-shaped elements) the two circular halves 7a, will entirely rest against the pipe. The parallelly extending edges 8 and 9 which follow the circular portions 7a, 7b serve as additional supports for the pipe to be bent, viz. in two diametrically opposite pressure points 8a and 9a of the pipe.

When a pipe of e.g. 11 – 15 mm has to be bent, one or a plurality of disc-shaped elements 5c, 5d should be positioned between the two circular segment halves 5a and 5b, dependent on the pipe diameter. Since the radius of the two circular portions 7a and 7b however remains unaltered, it will be clear that pipes having one of the said diameters of 11 – 15 mm cannot be entirely embraced by the slot section but only in some points thereof, as for instance in the points of support 7c and 7d and in the two diametrically opposite pressure points 8a and 9a of said 11 – 15 mm pipes.

It has been experimentally established that the circular portions 7a and 7b exert little or no influence on the quality of a pipe during the bending operation. However it is important that the end 7c of each of the circular portions in the bottom portion of the slot section are rounded, since these two points serve as support for the pipe to be bent. Said points of support 7c, together with the pressure points 8a and 9a of the pipes abutting the edges 8 and 8, and which are highly important during the bending operation, are sufficient to bend a pipe without corrugations and without the pipe being flattened. As a result of the fact that pipes of different diameters only find support on the two points of support and two pressure points, it is possible, by means of one circular segment, with the addition of one or a plurality of elements, to bend pipes in a specific group of diameters.

Figure 6:
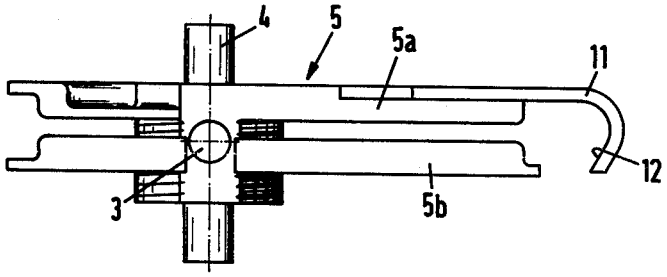
FIG. 6 shows a view of the divided circular segment, one of the parts being rotatable about the pivot pin.

Instead of the fact that the two circular segment halves 5a and 5b are kept spaced apart by means of disc-shaped elements 5c, 5d, as shown in FIG. 6, one of the circular segment halves is rotatable about shaft 4 by means of a thread. The required distance between the two circular segment halves may therefore be adjusted by rotating the disc-shaped element 5b one or more times about the shaft 4. Possibly the resulting distance may be locked by means of bolts and nuts 5e.

In case the pipe diameters become too large, a circular segment having a larger radius should be employed, as earlier described. Said circular segment is positioned, in order to maintain the required distance to the second outer support 17, in for instance a recess 18 which is disposed in the two fork arms 14 and 15, which recesses lie at a greater distance from the second outer support. It will be clear that said recesses 18 are disposed in such a location in the fork arms that the ratio 1 : 1½ described in FIG. 2 is maintained. The proper location of the recess may be easily achieved by suitably curving the fork arms, seen from the second outer support in the direction of the recesses.

Depending on the employed circular segment, it is possible to apply a plurality of recesses in the arms 14 and 15. In order to prevent during the bending operation the pivot pin 4 from sliding out of the recesses 13 or 18, the recesses, in the bottom thereof, are directed backwardly 18a, as may be seen in FIG. 4. By way of example FIGS. 1, 2 and 3 only show two sets of recesses. It will be clear that the number of recesses may increase selectively.

From a viewpoint of economy of material, the connection between the lever bar 3 of the first lever 1 and the circular segment 5 is a threaded connection 19 (FIG. 2). When a pipe of a different group of diameters is to be bent, only the circular segment is to be unscrewed and to be replaced by a different one.

By designing also the connection between the lever bar 16 or 16a of the second lever 2 and the two fork arms as threaded connection 20 (FIG. 2), the lever bars 3 and 16, 16a may be selectively replaced by longer or shorter bars.

Figure 7:
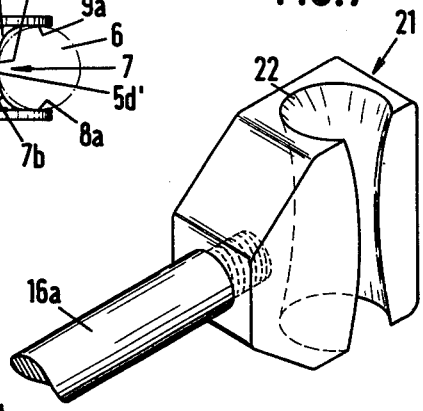
FIG. 7 shows a perspective view of a bending iron.

FIG. 7 shows a bending iron 21 which can be attached by means of threading on the lever bar 2, 16 or 16a. Said bending iron comprises a bore 22 which flares towards the free ends. Said bore is an open communication at one longitudinal side thereof to the surface of the bending iron. The shape of said bore is clearly shown in FIG. 7. The cross-section of said bore is such that for instance pipes having diameters of e.g. 10 – 20 mm fit therein. The object of said bending iron is to slightly bend a pipe which, after having been mounted, has not been sufficiently bent.

The specification speaks of a pipe. It will be clear that both a solid and a hollow pipe are concerned.

I claim:

1. A pipe bender for bending pipes, first and second pivotally interconnected levers, a pivot pin fixed to the first lever, and a circular segment coaxial therewith, which segment defines the inside bend of a pipe to be bent, a slot disposed in the circular peripheral portion of the circular segment, a first outer support for the pipe to be bent, spaced apart therefrom and positioned adjacent a circumferential end of the circular segment; and having at the second lever a fork having two arms which receive said pivot pin, and a second outer support for the pipe to be bent coupled to the second lever, one of the two fork arms being extended relative to the other fork arm, and carrying at the free end of its arm extension the second outer support, said arm extension being bent so that, in the direction of the free end of said extension has a receding configuration relative to the direction that is opposite to the direction of the bending operation; and the second outer support being spaced apart from the pivot pin in the order of at least the diameter of the pipe to be bent and the radius of the circular segment.

2. A pipe bender according to claim 1, wherein the stationary pivot pin attached to the first lever is mounted in recesses open towards the circumferential edge of the fork arms of the second lever.

3. A pipe bender according to claim 1, wherein the first outer support attached to the first lever has the shape of a hook embracing the pipe to be bent, and wherein the opening of the hook is directed towards the side of the extended fork arm carrying the second outer support.

4. A pipe bender according to claim 1 wherein the position of the second outer support with respect to the pivot pin is determined by the distance of a first line section going through the median perpendicular plane of the circular segment, intersecting the pivot pin in a first point, and intersecting an outer surface tangent of the pipe perpendicularly in a second point, from a second line section which is the outer surface tangent going through said second point and a third contact point of the second outer support and the pipe, when the pipe, after having been installed, both contacts the second outer support in said third point and presses against the bottom section of the slot of the circular segment, the ratio of the first and second line sections being 1 : 1 to 1 : 1½.

5. A pipe bender according to claim 4, wherein there is provided at least one additional specimen of a first lever with circular segment and first outer support for bending pipes of a different group of diameters, where being provided for said further specimen in the second lever a second pivot pin bearing comprising a further pair of recesses in the two fork arms open towards the edge in such a way that said ratio is maintained.

6. A pipe bender according to claim 1, wherein the circular segment relative to its median perpendicular plane, comprises two halves, spacing means for positioning said halves apart from each other so that by means of the same circular segment pipes of different diameters may be bent.

7. A pipe bender according to claim 6, wherein the spacing means are formed by at least one disc-shaped means positioned between the halves, the shape of the disc-shaped means beig such that the edge surfaces thereof, which bound the bottom section of the slot recede relative to the bottom section.

8. A pipe bender according to claim 6, wherein at least one of the halves is rotatable by means of threading about the pivot pin in order to adjust the required distance between the two halves.

9. A pipe bender according to claim 6, wherein the cross-section of the slot, adjacent the bottom in the adjacent halves has substantially a curve that corresponds to the radius of the pipe having the smallest diameter from the group of pipes of different diameters to be bent, the cross-section in the direction towards the outer edge of the slot remaining substantially equal and bearing against the pipe to be bent.

10. A pipe bender according to claim 6, wherein the corners of the two halves of the circular segment which bound the bottom of the slot are rounded in order to serve as pressure points for the pipes to be bent without these pipes being dented by the pressure points in an undesirable manner.

11. A pipe bender according to claim 6, wherein the two fork arms are so spaced apart from each other that the halves of the circular segment even when spaced apart can be disposed between the fork arms.

12. A pipe bender according to claim 1, wherein said circular segment has an end portion and said first outer support has a hook-shaped portion and wherein for supportingly installing a pipe to be bent in the slot, there is removed in the lower edge adjacent the end portion and adjacent the hook-shaped portion, such a part of said edge that a pipe to be bent can be installed in the slot between the removed portion of said edge and the end of the hook-shaped portion.

13. A pipe bender according to claim 12, wherein the end of the hook-shaped portion of the first outer support is bevelled in order to further facilitate the installation of a pipe.

14. A pipe bender according to claim 1, wherein the second outer support is substantially a straight cylinder which is rotatable about its axis that is normal to the two fork arms, there being provided radially extending edges along the ends of the cylinder surface for guiding a pipe to be bent.

15. A pipe bender according to claim 14, wherein the second outer support is slidingly disposed along its rotation axis in order to center the pipes to be bent relative to the slot of the circular segment.

16. Pipe bender for bending pipes, comprising first and second pivotally interconnected levers, a pivot pin affixed to the first lever, and a circular segment coaxial therewith, which segment defines the inside bend of a pipe to be bent, a slot disposed in the circular circumferential portion of the circular segment, a first outer support for the pipe to be bent, spaced apart therefrom and positioned adjacent a circumferential end of the circular segment; and a fork having two arms at the second lever, which arms receive said pivot pin, and a second outer support for the pipe to be bent coupled to the second lever, the second outer support being disposed between the fork arms and between the circular segment and the lever arm of the second lever, the fork arm portions between their pivot pin receiving points and the second outer support, in the plane of each of said arms, having such a bent shape that the fork arm portions, seen from the pivot pin receiving points in the direction of the second outer support, have a configuration receding in the direction opposite to the direction of the bending operation, so that the lever arm of the first lever during the bending operation can pass between the free ends of the fork arms, and that the second outer support is spaced apart from the pivot pin in the order of at least the diameter of the pipe to be bent and the radius of the circular segment.

17. A pipe bender according to claim 2, wherein the position of the second outer support with respect to the pivot pin is determined by the distance of a first line section going through the median perpendicular plane of the circular segment, intersectig the pivot pin in a first point, and intersecting an outer surface tangent of the pipe perpendicularly in a second point, from a second line section which is the outer surface tangent going through said second point and a third contact point of the second outer support and the pipe, when the pipe, after having been installed, both contacts the second outer support in said third point and presses against the bottom section of the slot of the circular segment, the ratio of the first and second line sections being 1 : 1 to 1 : 1 1½.

18. A pipe bender according to claim 17, wherein there is provided at least one additional specimen of a first lever with circular segment and first outer support for bending pipes of a different group of diameters, there being provided for said further specimen in the second lever a second pivot pin bearing comprising a further pair of recesses in the two fork arms open towards the edge in such a way that said ratio is maintained.

19. A pipe bender according to claim 16, wherein the stationary pivot pin attached to the first lever is mounted in recesses open towards the circumferential edge of the fork arms of the second lever.

20. A pipe bender according to claim 16, wherein the first outer support attached to the first lever has the shape of a hook embracing the pipe to be bent, and wherein the opening of the hook is directed to one of the fork arms carrying the second outer support.

21. A pipe bender according to claim 16, wherein the two fork arms are so spaced apart from each other that the halves of the circular segment even when spaced apart can be disposed between the fork arms.

22. A pipe bender according to claim 16, wherein the circular segment relative to its median perpendicular plane, comprises two halves, spacing means for positioning said halves apart from each other so that by means of the same circular segment pipes of different diameters may be bent.

23. A pipe bender according to claim 22, wherein the spacing means are formed by at least one disc-shaped means positioned between the halves, the shape of the disc-shaped means being such that the edge surfaces thereof, which bound the bottom section of the slot, recede relative to the bottom section.

24. A pipe bender according to claim 22, wherein at least one of the halves is rotatable by means of threading about the pivot pin in order to adjust the required distance between the two halves.

25. A pipe bender according to claim 22, wherein the cross-section of the slot, adjacent the bottom in the adjacent halves has substantially a curve that corresponds to the radius of the pipe having the smallest diameter from the group of pipes of different diameters to be bent, the cross-section in the direction towards the outer edge of the slot remaining substantially equal and bearing against the pipe to be bent.

26. A pipe bender according to claim 22, wherein the corners of the two halves of the circular segment which bound the bottom of the slot are rounded in order to serve as pressure points for the pipes to be bent without these pipes being dented by the pressure points in an undesirable manner.

27. A pipe bender according to claim 16, wherein said circular segment has an end portion and said first outer support has a hook-shaped portion and wherein for supportingly installing a pipe to be bent in the slot, there is removed in the lower edge adjacent the end portion and adjacent the hook-shaped portion, such a part of said edge that a pipe to be bent can be installed in the slot between the removed portion of said edge and the end of the hook-shaped portion.

28. A pipe bender according to claim 27, wherein the end of the hook-shaped portion of the first outer support is bevelled in order to further facilitate the installation of a pipe.

29. A pipe bender according to claim 16, wherein the second outer support is substantially a straight cylinder which is rotatable about its axis that is normal to the two fork arms, there being provided radially extending edges along the ends of the cylinder surface for guiding a pipe to be bent.

30. A pipe bender according to claim 29, wherein the second outer support is slidingly disposed along its rotation axis in order to center the pipe to be bent relative to the slot of the circular segment.

* * * * *

UNITED STATES PATENT AND TRADEMARK OFFICE

CERTIFICATE OF CORRECTION

PATENT NO. : 4,132,100

DATED : January 2, 1979

INVENTOR(S) : Jacob Pieter Schuler

It is certified that error appears in the above-identified patent and that said Letters Patent are hereby corrected as shown below:

Column 10, line 38, change "2" to -- 16 -- and line 42, change "intersectig" to

-- intersecting --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*